United States Patent [19]

Miller

[11] Patent Number: 4,781,527

[45] Date of Patent: Nov. 1, 1988

[54] CARTRIDGE PUMP

[75] Inventor: E. Kent Miller, Rockford, Ill.

[73] Assignee: Sundstand Corporation, Rockford, Ill.

[21] Appl. No.: 841,430

[22] Filed: Mar. 19, 1986

[51] Int. Cl.[4] ..... F01D 15/10

[52] U.S. Cl. ..... 415/127; 417/361; 222/333; 415/150; 415/151

[58] Field of Search ..... 415/148, 150, 151, 126–128, 415/121 R; 417/360, 361; 222/368, 333, 385

[56] References Cited

U.S. PATENT DOCUMENTS

| | | | |
|---|---|---|---|
| 235,743 | 12/1880 | Corliss . | |
| 2,083,447 | 6/1937 | Hoffman | 415/151 X |
| 2,480,435 | 8/1949 | Aspelin . | |
| 2,562,268 | 7/1951 | Gratzner . | |
| 2,869,282 | 2/1945 | Curtis et al. . | |
| 3,000,543 | 9/1961 | Paul . | |
| 3,035,743 | 5/1962 | Freeman . | |
| 3,316,846 | 5/1967 | Bender . | |
| 3,539,272 | 11/1970 | Howard et al. . | |
| 3,583,833 | 6/1971 | Huber et al. . | |
| 4, 049,364 | 8/1977 | Ross et al. . | |
| 4,115,038 | 9/1978 | Litzenberg . | |
| 4,116,583 | 9/1978 | Budris . | |
| 4,318,667 | 3/1982 | Miller . | |
| 4,324,532 | 4/1982 | Knife . | |
| 4,439,096 | 3/1984 | Rockwood et al. . | |
| 4,486,152 | 12/1984 | Porel . | |
| 4,611,529 | 9/1986 | Stricker et al. | 417/36 |

OTHER PUBLICATIONS

Proposal E24-29-P4, vol. II—Technical, Ram Air Turbine for the A320 Aircraft, pp. 3-29-3-32, Aug. 1984.

*Primary Examiner*—Robert E. Garrett
*Assistant Examiner*—Joseph M. Pitko
*Attorney, Agent, or Firm*—Wood, Dalton, Phillips, Mason & Rowe

[57] ABSTRACT

A cartridge or plug-in pump for use in a fluid holding receptacle such as an aircraft fuel tank. A pump housing on the fluid holding receptacle has an inlet opening to allow passage of fluid from the receptacle into the pump housing. A plug-in pump assembly is axially and rotatably positionable in the pump housing. A pump inlet closure is mounted on the pump housing for movement between inlet open and closed postions. Seals are provided between the pump housing and the pump assembly. A first actuator moves the closure to its inlet closed position in response to rotational movement of the pump assembly relative to the pump housing. A second actuator moves the pump assembly axially relative to the pump housing to break the seals also in response to rotational movement of the pump assembly relative to the pump housing. The first and second actuators are synchronized whereby the closure is in its inlet closed position at the time the seals are broken.

25 Claims, 3 Drawing Sheets

CARTRIDGE PUMP

DESCRIPTION

1. Field of the Invention

This invention generally relates to cartridge-type pumps and, particularly, to a cartridge-type pump for use in a fluid holding receptacle where it is desired to quickly and readily perform pump maintenance or replacement.

2. Background of the Invention and the Prior Art

Historically, cartridge or plug-in pumps have been employed in those environments where the pump is housed within the confines of a tank or receptacle containing fluid to be delivered under pressure remote from the tank or receptacle. Plug-in pumps are so designed as to permit their ready removal from the tank or receptacle for replacement or repair. The pumps may be primary sources of fluid under pressure, or they may function as boost pumps to deliver the fluid from the tank or receptacle to another pump for final delivery to a system end use.

For instance, in aircraft applications, it has been found desirable to mount a fuel boost pump assembly within a fuel tank and, preferably, to mount the fuel boost pump assembly within the fuel storage tank adjacent a bottom wall thereof. This allows access from below, as well as ensuring that all fuel resting on the bottom of the tank is drawn off by the pump for its ultimate intended use. However, when the fuel boost pump is so mounted, some means must be provided so that the pump and motor unit thereof can be readily removed from the fuel tank for replacement or other maintenance problems.

For some time, access means were provided in the top wall of the fuel storage tank to provide means for inserting and removing the pump and motor unit from the storage tank. However, such access means required that the fuel in the fuel storage tank be drained prior to the insertion or the removal of the pump and motor unit in order to permit a mechanic to locate the detachable mounting means to respectively secure or release the pump and motor unit from the interior of the fuel tank.

In order to obviate the problem or requirement of draining the fuel tank, cannister or plug-in pump assemblies have been designed to provide for inserting the pump and motor unit through an access means formed in the bottom wall of the fuel storage tank. In such designs, the motor-driven boost pump is placed in a cannister assembly disposed within the fuel tank and mounted on the bottom wall thereof. The cannister has an open lower end through which the pump may be installed and removed. The cannister is provided with suitable valving for isolating any fuel in the tank from the pump. With this type of installation, maintenance is greatly facilitated since it is no longer necessary to empty the fuel tank whenever servicing, repair or replacement of the pump is necessary.

For instance, cartridge or plug-in pump assemblies are shown in U.S. Pat. Nos. 3,000,543 to Paul, dated Sept. 19, 1961; 3,539,272 to Howard et al, dated Nov. 10, 1970; and 4,324,532 to Knife, dated Apr. 13, 1982. All three of these patents show boost-type pump applications where it is desirable to mount a fuel boost pump assembly within a fuel tank. In each patent, there is provided a valve which is automatically closed to seal the fuel tank upon removal of the boost pump cannister or cartridge. The valves are in the form of cylindrical sleeves. In Paul U.S. Pat. No. 3,000,543 and Knife U.S. Pat. No. 4,324,532, the cylindrical valve sleeve moves axially as the cartridge pump assembly is axially removed from the fuel tank. In Howard U.S. Pat. No. 3,539,272, the cylindrical valve sleeve rotates to a closed position upon rotation of the cartridge pump assembly.

U.S. Pat. No. 4,318,667 to Miller, dated Mar. 9, 1982 and assigned to the assignee of this invention, points out that in prior art as enumerated above, there is the need for some sequential steps in the removal of the pump to assure that removal of the pump will not inadvertently allow the fuel in the tank to escape through the tank opening in which the pump is removed. As stated in Miller, the prior art does not include any means to insure that a valve which closes off a fuel passage to the pump is locked in place prior to removal of the pump. In addition, the prior art made no provision to preclude fuel pump drainage, until a valve which closes a fuel passage to the pump is locked in place. Although Miller uses a valve sleeve, similar to the other enumerated prior art, an actuating mechanism is disclosed for the fluid pump inlet closure valve sleeve. The actuating mechanism includes a handle which is mechanically coupled to the valve sleeve whereby initial manual movement of the handle causes the valve sleeve to move into a position blocking the opening to the fuel tank, whereupon subsequent pivotal movement of the handle allows unobstructed passage of the pump from the housing. The handle must be pulled first in one direction and then turned or pivoted in a second direction to thereby sequentially place the inlet closure valve in a closed position and thereafter allow the pump to be freed for ready removal.

In all of the prior art cited above, the cartridge pump assembly is mounted on or in the fuel tank in a vertical orientation through the bottom wall of the fuel tank. There are instances, however, where such cartridge or plug-in pump assemblies could be more advantageously mounted in a side wall of a fuel tank or other fluid holding receptacle, with the cartridge or plug-in pump assembly in a horizontal disposition. A problem with such horizontal mounting of the cartridge pump assembly concerns the envelope constraints on the overall construction caused by outside support structures surrounding the fuel tank. Consequently, sleeve-type closure valves as disclosed in the prior art enumerated above have not proven advantageous for such applications.

This invention is directed to solving one or more of the above problems by providing a new and improved cartridge or plug-in pump assembly.

SUMMARY OF THE INVENTION

An object, therefore, of the invention is to provide a new and improved cartridge-type pump assembly for use in a fluid holding receptacle such as aviation fuel systems and the like.

In the exemplary embodiment of the invention, an elongated pump housing is provided on the fluid holding receptacle or fuel tank. The pump housing has an inlet opening at the inner end of the housing to allow passage of fluid from the receptacle into the pump housing. Motor driven pump means are axially positionable in the housing and rotatable relative to the housing. Pump inlet closure means are mounted on the housing for movement toward and away from the inlet opening in a path generally transversely of the pump axis between inlet open and closed positions. In the preferred embodiment, the pump inlet closure means comprises a flap valve pivotally mounted for movement about an axis extending generally perpendicular to the pump axis. Seal means also are provided between the pump housing and the pump means. As disclosed herein, the pump housing has a generally cylindrical chamber within which at least a cylindrical end of the cartridge pump assembly is axially and rotatably positionable. The seal means comprises one or more O-rings between the pump housing and the pump means.

First actuator means are operatively associated between the pump means and the pump inlet closure means (flap valve) for moving the closure means to its inlet closed position in response to rotational movement of the pump means relative to the pump housing. Second actuator means are operatively associated between the pump housing and the pump means for moving the pump means axially relative to the pump housing to break the seal means in response to rotational movement of the pump means relative to the pump housing. The first and second actuator means are synchronized whereby the inlet closure means is in its closed position at the time the seal means is broken.

As disclosed herein, a pair of cam tracks are provided, one for effecting closing of the inlet closure means and the other for effecting axial movement of the pump means for breaking the seal means. The two cam tracks are cooperatively constructed so that the closure means first is moved to its closed position, the seal means then are broken, and the pump means then can be axially removed from the pump housing.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
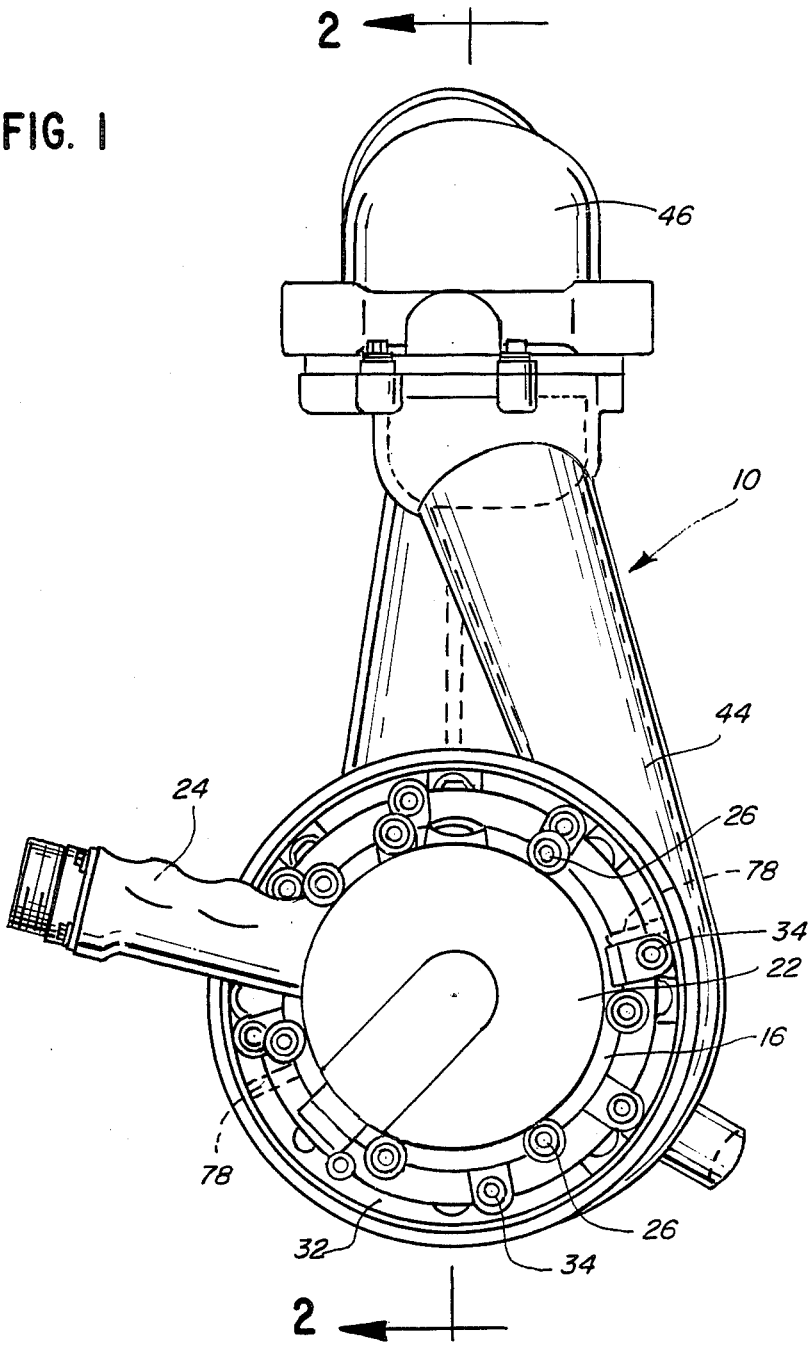
FIG. 1 is an outside end elevational view of the cartridge or plug-in boost pump of the invention.
Figure 2:
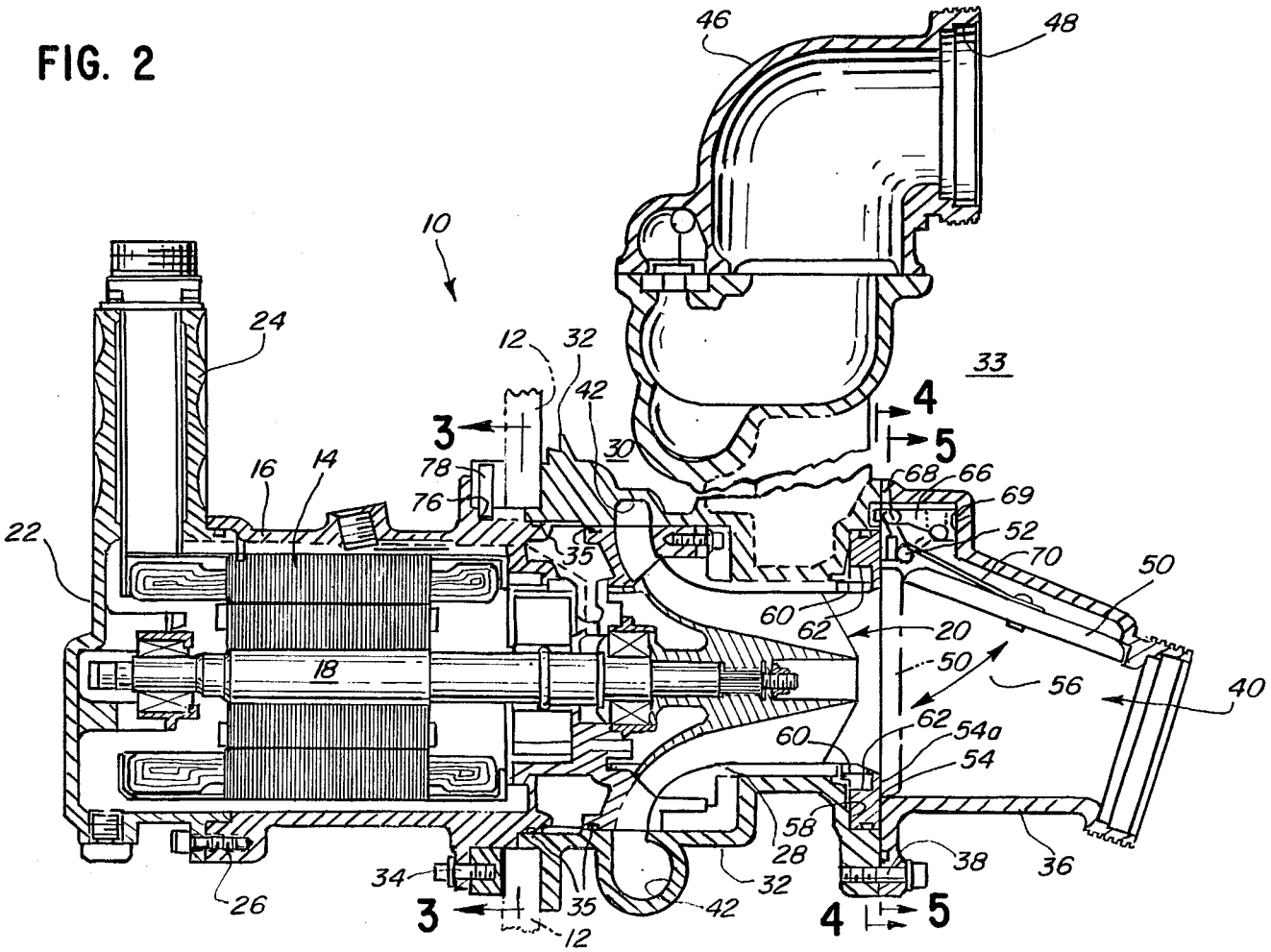
FIG. 2 is a vertical section taken generally along line 2—2 of FIG. 1.

Referring to the drawings in greater detail, and first to FIGS. 1 and 2, a cartridge or plug-in boost pump, generally designated 10, is designed for use in a fluid holding receptacle such as an aircraft fuel tank. For instance, a wall 12 of an aircraft wing "spar" is shown in phantom in FIG. 2. Wall 12 is generally vertically oriented, and it can be seen that boost pump assembly 10 is mounted through wall 12 in a horizontal disposition. A pump motor 14 is mounted within a pump housing 16 and includes a motor rotor shaft 18 having an impeller, generally designated 20, on the inner distal end thereof (the right-hand end as viewed in FIG. 2). Motor housing 16 has an end housing 22 having an integral, radially projecting handle 24 for grasping by a mechanic or other individual to rotate and axially move the pump assembly, as described hereinafter. End housing 22 is secured integrally with motor housing 16 by fastening means 26. An interior impeller housing 28 surrounds impeller 20 and is secured integrally to the inner end of motor housing 16 by fastening means 30.

From the foregoing, it can be seen that rotation of handle 24 and end housing 22 effects rotation of motor housing 16 and impeller housing 28. This composite pump assembly is axially and rotatably positionable within a pump housing 32 which projects into a fuel tank 33. Appropriate fasteners 34 secure motor housing 16 to pump housing 32 and fix the cartridge pump assembly in position relative to wing spar 12. Fasteners 34 must be removed to permit removal of the plug-in pump assembly. Seal means in the form of a pair of O-rings 35 are disposed between pump housing 32 and motor housing 16 of the pump assembly. Pump housing 32 has an inner nozzle portion 36 secured thereto by fasteners 38, with the nozzle projecting into the fuel tank.

Pump housing 32, including nozzle 36, defines an inlet opening 40 to allow passage of fluid from fuel tank 33 into impeller housing 28 and to impeller 20. Outlet means 42 (FIG. 2) is provided in pump housing 32 in communication with impeller 20 and leads to a "volute" 44 (FIG. 1) which directs the impelled fluid to an outlet coupling 46 having an outlet opening 48.

Pump inlet closure means are provided and includes a flap valve 50 pivotally mounted at 52 to a closure ring 54 which defines a valve seat 54*a*. Flap valve 50 is movable in a path indicated by double-headed arrow 56 generally transversely of the pump axis between an inlet open position (as shown in full lines in FIG. 2) and an inlet closed position (as shown in phantom in FIG. 2). Closure ring 54 is rotatably mounted within a groove 58 in pump housing 32. Impeller housing 28 has a plurality of axially inwardly projecting ears or tabs 60 located within notches 62 in closure ring 54. Therefore, rotation of impeller housing 28 effects rotation of closure ring 54 and flap valve 50, yet tabs 60 and notches 62 allow for axial removal of the impeller housing along with the remainder of the cartridge or plug-in pump assembly.

Figure 7:
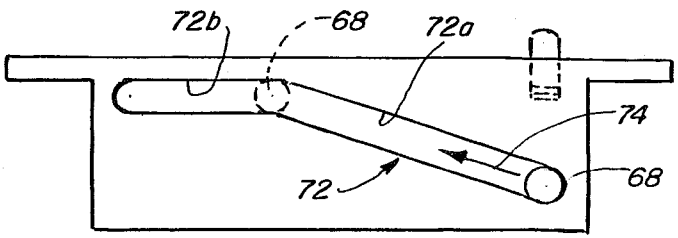
FIG. 7 is an isolated view of the cam track for closing the pump inlet closure means, and looking generally in the direction of arrows 7—7 of FIG. 5.
Figure 5:
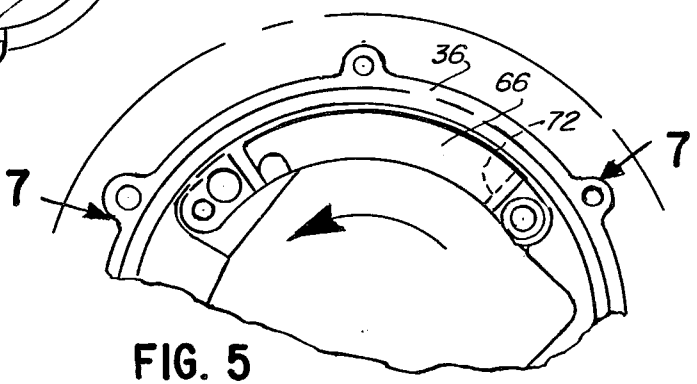
FIG. 5 is a view taken generally in the direction of line 5—5 of FIG. 2.
Figure 4:
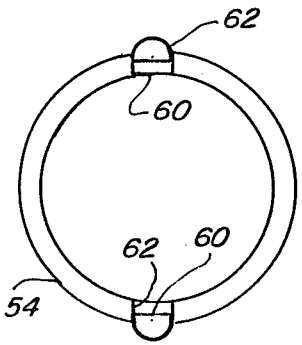
FIG. 4 is a view taken generally in the direction of line 4—4 of FIG. 2.
Figure 6:
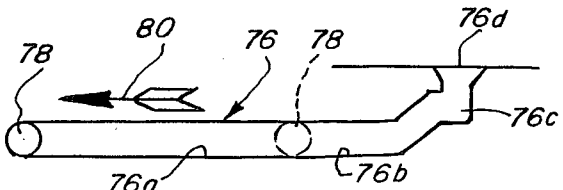
FIG. 6 is an isolated view of the cam track for breaking the seal for the pump, and looking generally in the direction of arrows 6—6 of FIG. 3.

First actuator means are provided for effecting movement of flap valve 50 and includes a cam member 66 fixed stationarily within a recess 69 in nozzle 36. A cam follower arm 68 is unitary with flap valve 50 through a valve arm 70. As best seen in FIGS. 5 and 6, in conjunction with FIG. 2, cam member 66 is provided with a cam track, generally designated 72. Cam follower 68 rides in cam track 72 as closure ring 54 and flap valve 50 rotate with the plug-in pump assembly. As will be described in greater detail hereinafter, cam follower 68 is illustrated in FIG. 7 at its valve open position relative to the cam track. A cam track portion 72*a* is effective to close the valve by movement of cam follower 68 therealong in the direction of arrow 74. When cam follower 68 reaches the position shown in dotted lines in FIG. 7, flap valve 50 will be in its closed position against valve seat 54*a* of closure ring 54. Cam track portion 72*b* of cam slot 72 is a "lost motion" area of the cam track.

Figure 3:
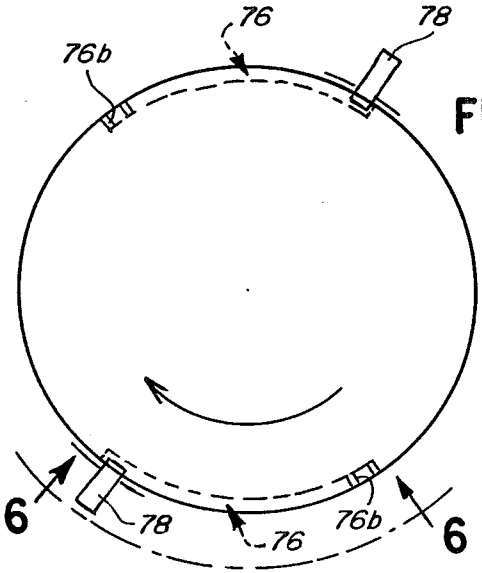
FIG. 3 is a view taken generally in the direction of line 3—3 of FIG. 2.

Second acutator means are operatively associated between pump housing 32 and the plug-in pump assembly, particularly motor housing 16, for moving the pump assembly axially relative to the pump housing to break the seal of O-ring seals 35 in response to rotational movement of the pump assembly relative to pump housing 32. More particularly, referring to FIGS. 2, 3 and 6, a cam track, generally designated 76, is formed in a portion of the outer periphery of motor housing 16. A cam follower pin 78 is fixed positionally to pump housing 32 and projects inwardly into cam track 76 for riding therealong. In the embodiment illustrated, as seen in FIGS. 1 and 3, two unequally spaced cam tracks 76 and cam follower pins 78 are provided to give more uniform separating forces about the pump assembly and unequally circumferentially spaced to prevent incorrect assembly of the plug-in pump into the pump housing 32.

Referring particularly to FIG. 6, cam track 76 is shown to include a "lost motion" cam track portion 76*a*, a seal breaking cam track portion 76*b* and a pump removal cam track portion 76*c* leading to a removal slot portion 76*d*. Follower pin 78 is illustrated (in full lines) at the extreme inner end of cam track 76 at the beginning of lost motion cam track portion 76*a*. This corresponds to the valve open position of flap valve 50 and corresponds to the full line position of cam follower arm 68 in cam track 72 as shown in FIG. 7. As the plug-in pump assembly is rotated by means of handle 24, as stated above, cam follower arm 68 will move along cam track portion 72*a* in the direction of arrow 74 (FIG. 7) to effect pivotal closing of flap valve 50 until cam follower arm 68 reaches its valve closed position as indicated by the dotted lines in FIG. 7. During this increment of movement, cam follower pin 78 (FIG. 6) simply rides in the lost motion cam track portion 76*a* as the plug-in pump assembly is rotated in direction of arrow 80 (FIG. 6) until cam follower pin 78 reaches the position shown in dotted lines which corresponds to the valve closed position. Further rotation of the plug-in pump assembly causes valve cam follower arm 68 simply to move along lost motion cam track portion 72*b* as described above in relation to FIG. 7. However, during this further rotational movement, cam track portion 76*b* (FIG. 6) ramps over follower pin 78 to effect axial movement of the plug-in pump assembly and to break the seal of O-ring seals 35. Cam follower pin 78 then moves along cam track portion 76*c* until the pin reaches removal slot portion 76*d* of the cam track whereupon the plug-in pump assembly can be readily moved out of pump housing 32. All the while that cam follower pin 78 is moved from its dotted-line position shown in FIG. 6 to and through removal slot portion 76*d*, valve cam follower arm 68 simply moves within lost motion cam track portion 72*b* as shown in FIG. 7.

The construction of cam track 76 is designed to provide an initial high-force mechanical advantage for initially breaking the seal of the O-rings before axially withdrawing the pump which would fully break the effective seal of the O-rings. During use, the O-rings are exposed to very high temperatures, particularly in aircraft applications, and the O-rings acquire a "set" between pump housing 32 and motor housing 16. The O-rings actually can vulcanize to their seats. Therefore, extraordinary forces are required to break these seals. Simple axial movement of the plug-in pump assembly out of pump housing 32 would require unrealistic pull-out forces for manual removal. Therefore, the mechanical advantages afforded by converting rotational movement of the plug-in pump assembly to axial movement by means of cam track 76 and cam follower pin 78 affords easy breaking of the seals. To this end, it can be seen that the angle of cam track portion 76*b* (FIG. 6) is somewhat shallow in order to provide the high forces required. Once the seals are broken, a more inclined cam track portion 76*c* can be used to effect axial movement of the plug-in pump assembly until cam follower pin 78 reaches removal slot portion 76*d* of the cam track.

From the foregoing, it can be seen that the designs of cam tracks 72 and 76 are interrelated and cooperate with each other to provide a synchronized actuator operation whereby the pump inlet closure means, i.e. flap valve 50, first is closed, the pump seal means then are broken and the plug-in pump assembly thereafter can be removed from pump housing 32. This sequence of operation and the mechanical advantages afforded by the structural combination of this invention cannot be achieved by the sleeve-type valves of the prior art. In addition, the invention insures that the valve which closes off the fuel passage to the pump is locked in place prior to removal of the pump.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a fluid holding receptacle, including in combination, a pump housing on the fluid holding receptacle and having an inlet opening to allow passage of fluid from the receptacle into the pump housing, pump means rotatably positionable in the pump housing on an axis, pump inlet closure means mounted on the housing for movement in a path generally transversely of the pump axis between inlet open and closed positions, and actuator means operatively associated between the pump means and the pump inlet closure means for moving the closure means generally transversely of the pump axis to its inlet closed position in response to rotational movement of the pump means about said axis.

2. In a fluid holding receptacle as set forth in claim 1 wherein said pump inlet closure means include a flap valve movable in said path.

3. In a fluid holding receptacle as set forth in claim 2, including means mounting the flap valve for pivotal movement about an axis generally perpendicular to and spaced from the pump axis.

4. In a fluid holding receptacle as set forth in claim 3, wherein said actuator means include cam means for moving the flap valve about its pivot axis.

5. In a fluid holding receptacle as set forth in claim 4 wherein said cam means include a cam track on the pump housing and a cam track follower operatively connected to the flap valve and movable in the cam track in response to rotation of the pump means.

6. In a fluid holding receptacle as set forth in claim 5, including means mounting the flap valve for rotating movement bodily about the pump axis conjointly with the pump means, the cam track on the housing being stationary.

7. In a fluid holding receptacle, including in combination, an elongated pump housing on the fluid holding receptacle and having an inlet opening at the inner end of the housing to allow passage of fluid from the receptacle into the pump housing, pump means axially positionable in the housing and rotatable relative thereto, pump inlet closure means mounted on the housing for movement toward and away from the inlet opening to close and open the opening, and actuator means operatively associated between the pump means and the pump inlet closure means for moving the closure means to inlet closed position in response to rotational movement of the pump means.

8. In a fluid holding receptacle as set forth in claim 7 wherein the pump inlet closure means include a flap valve movable toward and away from the inlet opening.

9. In a fluid holding receptacle as set forth in claim 8, including means mounting the flap valve for pivotal movement about an axis generally perpendicular to and spaced from the pump axis.

10. In a fluid holding receptacle as set forth in claim 9, wherein said actuator means include cam means for moving the flap valve about its pivot axis.

11. In a fluid holding receptacle as set forth in claim 10 wherein said cam means include a cam track on the pump housing and a cam track follower operatively connected to the flap valve and movable in the cam track in response to rotation of the pump means.

12. In a fluid holding receptacle as set forth in claim 11, including means mounting the flap valve for rotating movement bodily about the pump axis conjointly with the pump means, the cam track on the housing being stationary.

13. In a fluid holding receptacle, including in combination, a pump housing on the fluid holding receptacle and having an inlet opening to allow passage of fluid from the receptacle into the pump housing, pump means rotatably positionable in the pump housing on an axis, seal means between the pump housing and the pump means, and actuator means operatively associated between the pump housing and the pump means for moving the pump means axially relative to the pump housing to break the seal means in response to rotational movement of the pump means relative to the pump housing.

14. In a fluid holding receptacle as set forth in claim 13 wherein said actuator means include cam means for biasing the pump means axially in response to rotational movement thereof.

15. In a fluid holding receptacle as set forth in claim 14 wherein said cam means include a cam track on one of the pump housing and the pump means and a cam track follower on the other of the pump housing and the pump means.

16. In a fluid holding receptacle as set forth in claim 15 wherein said cam means include a plurality of said cam tracks and cam followers spaced angularly about the pump housing and pump means.

17. In a fluid holding receptacle, including in combination, a pump housing on the fluid holding receptacle and having an inlet opening to allow passage of fluid from the receptacle into the pump housing, pump means rotatably positionable in the pump housing on an axis, seal means between the pump housing and the pump means, pump inlet closure means mounted on the housing for movement between inlet open and closed positions, first actuator means operatively associated between the pump means and the pump inlet closure means for moving the closure means to its inlet closed position in response to rotational movement of the pump means relative to the pump housing, and second actuator means operatively associated between the pump housing and the pump means for moving the pump means axially relative to the pump housing to break the seal means in response to rotational movement of the pump means relative to the pump housing, the first and second actuator means being synchronized whereby the inlet closure means is in its inlet closed position at the time the seal means is broken.

18. In a fluid holding receptacle as set forth in claim 17 wherein each said first and second actuator means include cam means for moving the closure means and the pump means, respectively.

19. In a fluid holding receptacle as set forth in claim 18 wherein each said cam means include a cam track and a cam track follower, the cam track of the first actuator means being on the pump housing and the respective cam track follower being operatively associated with the pump inlet closure means, and the cam track of the second actuator means being on one of the pump housing and the pump means and the respective cam track follower being on the other of the pump housing and the pump means.

20. In a fluid holding receptacle as set forth in claim 19 wherein said cam tracks have synchronized cam track portions for effecting closing of the inlet closure means before the seal means is broken.

21. In a fluid holding receptacle as set forth in claim 20 wherein the cam track of the second actuator means has a lost motion cam track portion within which the respective cam track follower moves while the cam track of the first actuator means effects closing of the inlet closure means.

22. In a fluid holding receptacle as set forth in claims 20 or 21 wherein the cam track of the first actuator means has a lost motion cam track portion within which the respective cam track follower moves while the cam track of the second actuator means effects axial movement of the pump means.

23. In a fluid holding receptacle as set forth in claim 19 wherein the cam means of the second actuator means include a plurality of said cam tracks and respective cam followers spaced angularly about the pump housing and pump means.

24. In a fluid holding receptacle as set forth in claim 17 wherein said pump inlet closure means include a flap valve movable in said path.

25. In a fluid holding receptacle as set forth in claim 24, including means mounting the flap valve for pivotal movement about an axis generally perpendicular to and spaced from the pump axis.

* * * * *